United States Patent [19]

Patel et al.

[11] 4,363,412

[45] Dec. 14, 1982

[54] CRANE COUNTERWEIGHT AND HANDLING METHOD

[75] Inventors: Ramesh P. Patel, Hagerstown, Md.; Alfred Bonnell, Jr., Greencastle, Pa.

[73] Assignee: Kidde, Inc., Clifton, N.J.

[21] Appl. No.: 178,344

[22] Filed: Aug. 14, 1980

[51] Int. Cl.[3] ..... B66C 23/76

[52] U.S. Cl. ..... 212/196; 414/719; 212/178; 280/759

[58] Field of Search ..... 212/195, 156, 191, 178, 212/270, 196; 414/719, 673, 498; 280/759

[56] References Cited

U.S. PATENT DOCUMENTS

| | | | |
|---|---|---|---|
| 3,375,021 | 3/1968 | Grider | 212/196 |
| 3,734,319 | 5/1973 | Frisk | 414/498 |
| 3,822,791 | 7/1974 | Eiler | 212/178 |
| 3,891,095 | 6/1975 | Symmank | 212/178 |
| 4,142,642 | 3/1979 | Meyers | 414/719 |
| 4,286,720 | 9/1981 | Atkinson | 212/178 |

*Primary Examiner*—John J. Love
*Assistant Examiner*—L. E. Williams
*Attorney, Agent, or Firm*—Brady, O'Boyle & Gates

[57] ABSTRACT

An extremely massive mobile crain counterweight requiring demounting from the crane rotary superstructure for separate transport or storage has self-contained raising and lowering mechanism which may be powered from the crane carrier and which forms a part of the counterweight mass. The internal counterweight mechanism is shielded from ballast, such as shot, which fills the interior of the counterweight. A foot plate forming a part of the raising and lowering mechanism of the counterweight is lockable in extended and retracted positions and is constructed for interlocking engagement with a locator structure on the crane carrier. An efficient and simplified sequence of counterweight manipulating steps is enabled.

16 Claims, 12 Drawing Figures

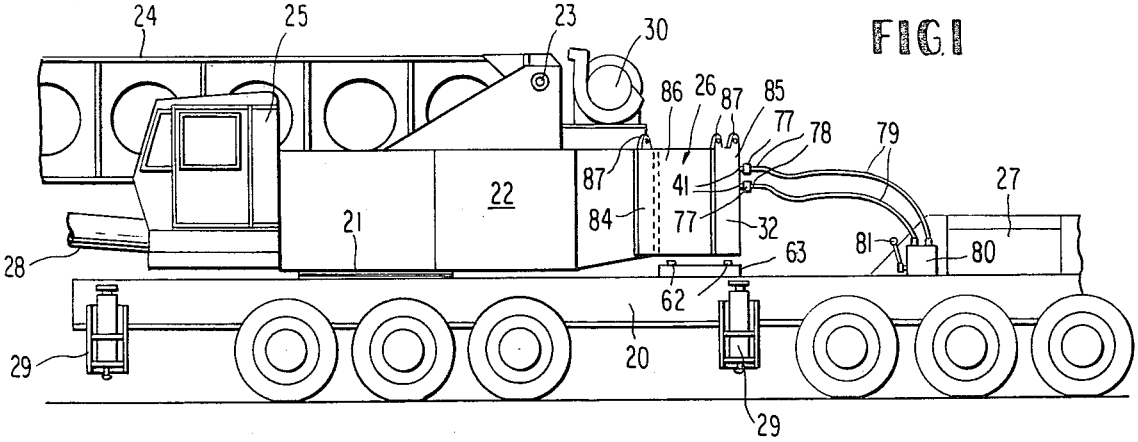
FIG. 1
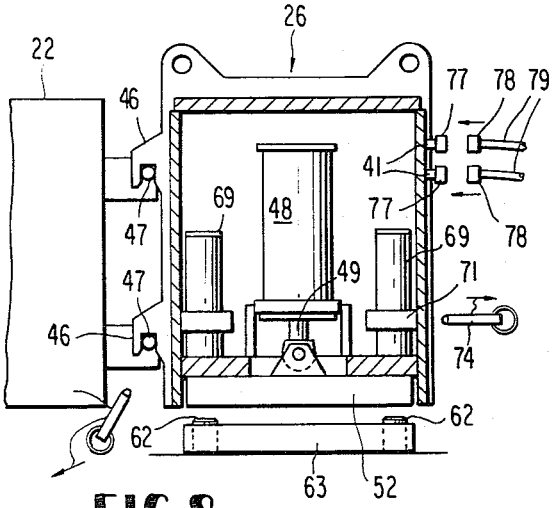
FIG. 8
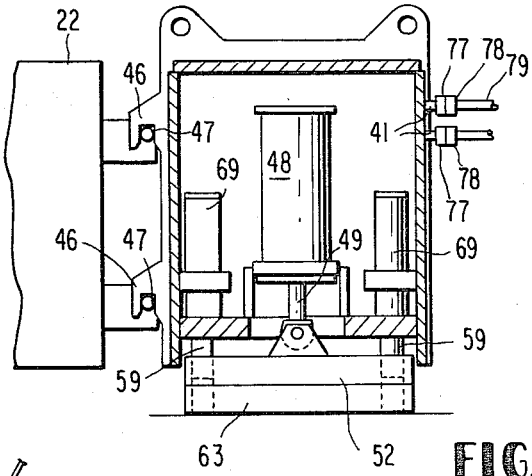
FIG. 9
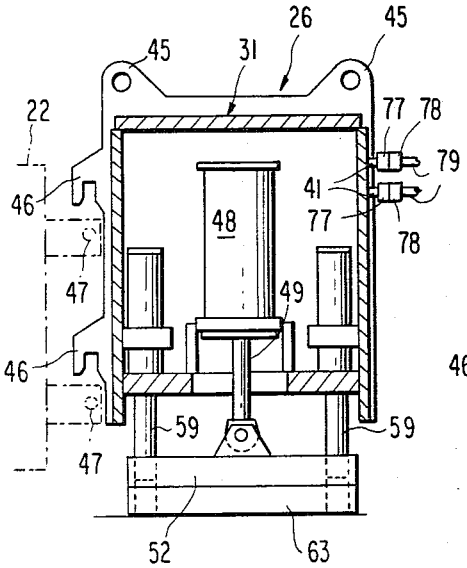
FIG. 10
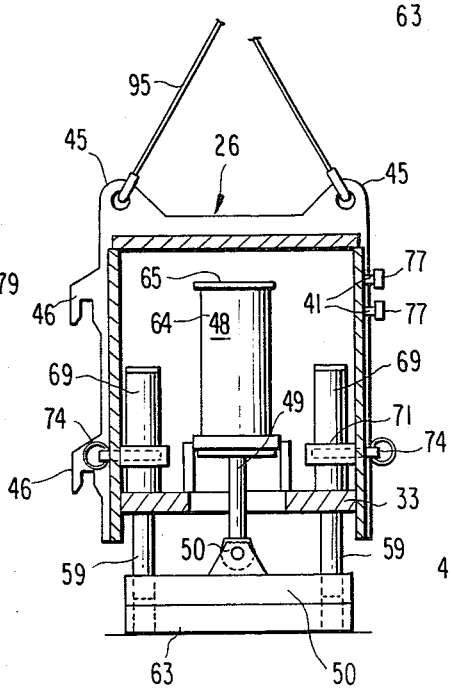
FIG. IIa
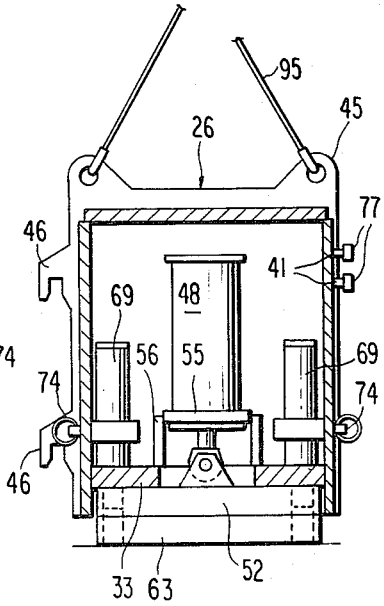
FIG. IIb

CRANE COUNTERWEIGHT AND HANDLING METHOD

BACKGROUND OF THE INVENTION

The development of increasingly large mobile construction cranes of the telescoping boom type has necessitated the use of correspondingly larger counterweights on the turntable mounted frame superstructure. These massive counterweights must be demounted in order to comply with highway maximum weight limitations and require transport on separate vehicles. It is also desirable at times to store the counterweight or place it on the ground. The mass of such a counterweight is so great that it requires the use of a large size crane to lift and manipulate it.

Accordingly, the objective of the present invention is to provide an improved structure for a very massive crane counterweight of the above-mentioned class and an improved more efficient method of handling the same. In achieving this objective, a power-operated raising and lowering means for the counterweight is built into the counterweight itself and therefore adds to the mass of the counterweight while rendering the structure compact.

The present invention is a radical departure from known prior art devices wherein the counterweight raising and lowering means are not self-contained in or on the counterweight but are a part of or on the crane superstructure. The self-contained power lifting means of the counterweight in accordance with the invention is not only more suitable for raising and lowering an extremely massive counterweight with stability, adequate guidance and safety but also contributes to the mass or weight, as stated.

Other features and advantages of the invention will become clearly apparent during the course of the following description.

BRIEF DESCRIPTION OF THE DRAWINGS

FIG. 1 is a fragmentary side elevation of a mobile crane equipped with counterweight in accordance with the invention.

FIGS. 8 through 11*b* are partly schematic side elevational views of the counterweight and associated elements depicting the method of handling the counterweight in accordance with the invention.

DETAILED DESCRIPTION

Figure 2:
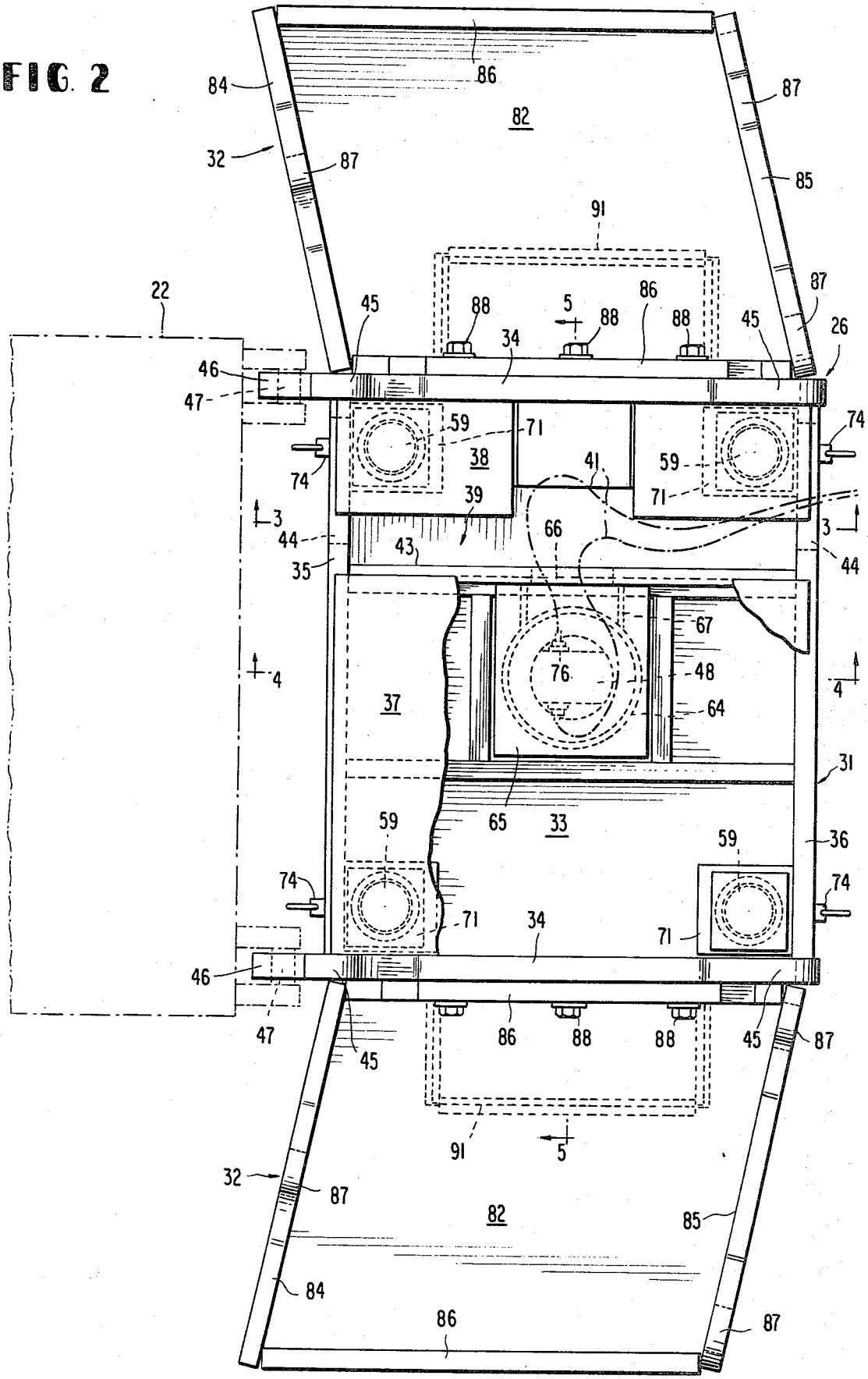
FIG. 2 is an enlarged plan view of the counterweight, partly broken away.

Referring to the drawings in detail wherein like numerals designate like parts, FIG. 1 illustrates a large mobile crane of a type on which the counterweight and associated mechanism according to the invention is employed. The crane comprises a multi-axle motorized carrier 20 having a turntable 21 near its rearward end for the rotational mounting of a superstructure 22 having an elevated pivot 23 for a hydraulically operated multi-section telescopic crane boom 24. A crane operator's cab 25 is provided on the superstructure 22. A counterweight assembly 26 according to the invention is detachably mounted on and bodily supported by the rear end of superstructure 22. In FIG. 1, the superstructure has been rotated so that the boom 24 and cab 25 face rearwardly longitudinally of the crane carrier 20 whose engine cowling 27 is shown near the forward end of the carrier 20 which also possesses a driver's compartment or cab at the front of the carrier, omitted in FIG. 1. Lifting cylinders 28 for the pivoted boom 24, crane carrier outriggers 29 and a cable winch 30 are also shown in FIG. 1. The details of construction of the crane may vary and the counterweight assembly can be employed on various types ad sizes of cranes.

The details of construction of removable counterweight assembly 26 are shown in FIGS. 2 through 7. The counterweight assembly 26 comprises a main or center section 31 which contains built-up counterweight raising and lowering means, to be described. The assembly further comprises opposite side counterweight sections 32 or wings rigid with the center section 31. The side sections 32, FIG. 2, are angled to fit the contour of the rear end of superstructure 22.

The center section 31 of counterweight assembly 26 is of box-like formation including a bottom wall 33, side walls 34, and front and rear walls 35 and 36. The terms "front" and "rear" pertaining to the assembly 26 have reference to the crane operator's cab 25 which is at the front of the turntable mounted superstructure 22, the counterweight assembly 26 being at the rear thereof. The center section 31 further comprises a large top plate or wall 37 covering a major portion of the top of the center section 31 and a smaller sectional top wall 38 near one side of the center section 31, there being an open gap 39 between the two top wall portions to make clearance for certain mechanism forming no direct part of this invention. The various walls of box-like center section 31 are rigidly united by welding.

Within one upper longitudinal corner of the center section 31 is constructed a longitudinal rectangular compartment 40 for the protection of hydraulic hoses 41, to be further described. The compartment 40 is formed by welded horizontal and vertical plates 42 and 43. Rectangular openings 44 in the front and rear walls 35 and 36 communicate with the compartment 40 and provide ready access to the hoses 41 which are normally stored therein.

The side walls 34 carry top cable or chain suspension lugs 45 substantially at the four corners of the center section 31. The side walls 34 additionally carry forward vertically spaced pairs of counterweight assembly support hooks 46 which are engageable with rigid support pins 47 at fixed location on the rear of superstructure 22.

Figure 4:
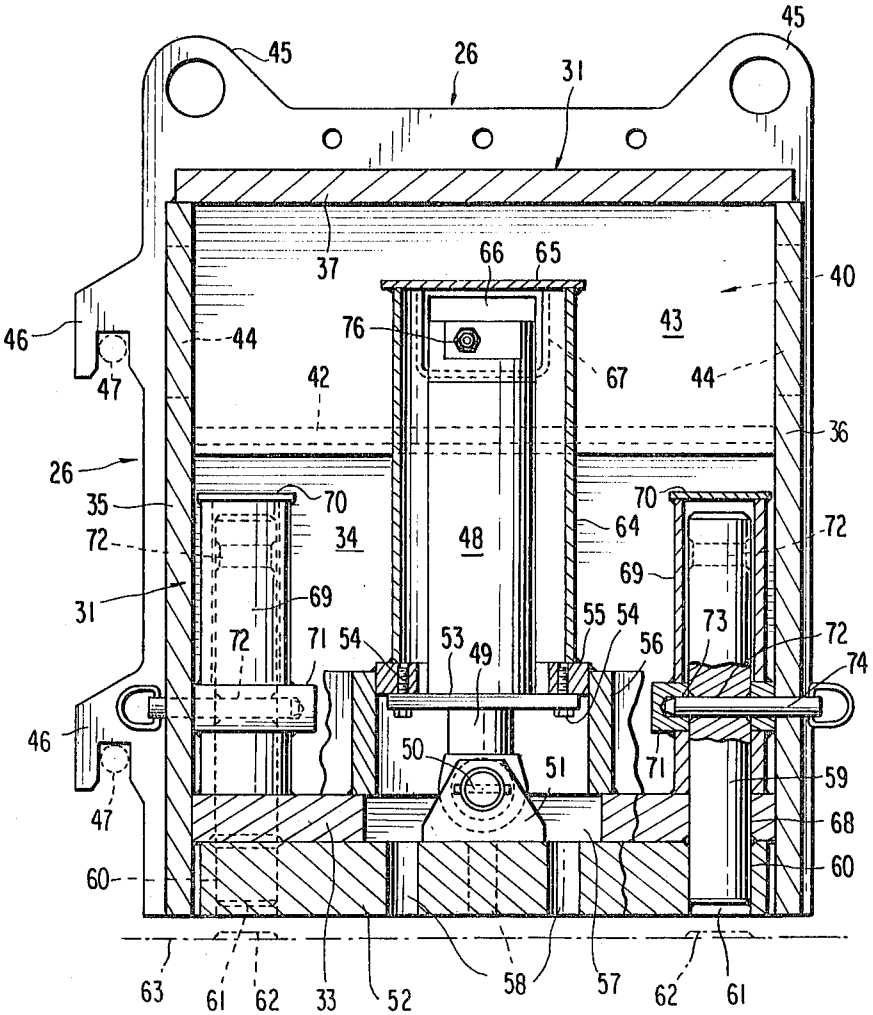
FIG. 4 is a similar section taken on line 4—4 of FIG. 2 with the counterweight foot plate retracted from its extended position of FIG. 3.
Figure 3:
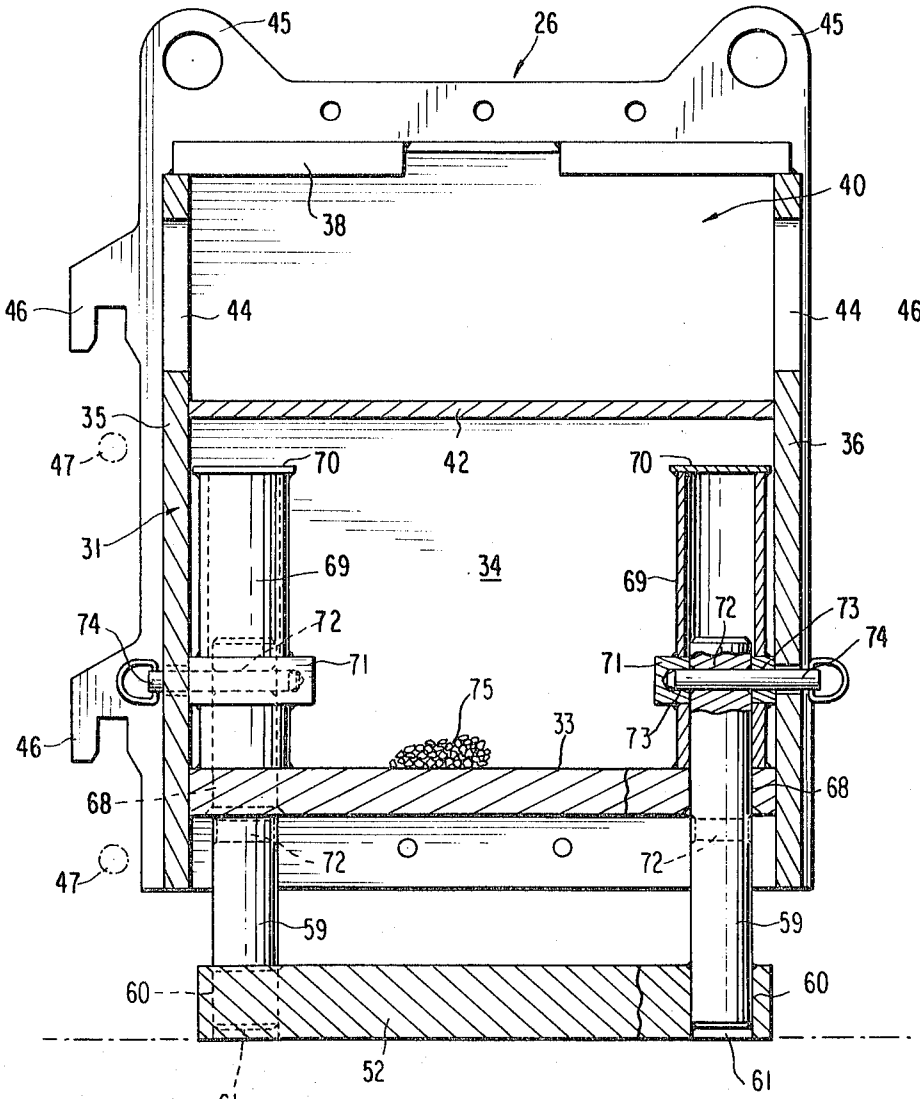
FIG. 3 is a vertical section taken on line 3—3 of FIG. 2.

The self-contained or built-in raising and lowering means for the entire counterweight assembly 26 is bodily on and within the center section 31 and comprises a central vertical axis hydraulic jack cylinder 48 having a depending piston rod 49 coupled through a pin 50 with lugs 51 welded to the top of a heavy rectangular foot plate 52 which is extendable and retractable vertically between the positions of FIGS. 3 and 4 by operation of the cylinder 48. The fixed bottom plate 33 is spaced upwardly sufficiently in the center section 31 to allow the foot plate 52 to nest below it, FIGS. 4 and 5, flush with the bottom edges of the vertical walls 34, 35 and 36.

A flange 53 on the lower end of cylinder 48 is bolted at 54 to an internal elevated plate 55, welded to and supported by a sleeve 56 which surrounds the rod 49 and associated elements and has its lower end welded to fixed bottom plate 33. A central opening 57 in the plate 33 allows the lugs 51 to project upwardly into the sleeve 56. Openings 58 formed through the foot plate 52, FIG. 4, allow access to the cylinder mounting bolts 54 when required.

Four corner parallel vertical guide posts 59 rise from the foot plate 52 with their lower end portions welded in openings 60 of the foot plate and spaced slightly above its bottom face to provide shallow locator sockets 61 at the bottom of the counterweight assembly. At proper times, locator pads 62 projecting from the top of a plate 63 attached to the crane carrier 20 beneath the counterweight assembly 26 enter the sockets or recesses 61 to properly locate or position the assembly 26 on the carrier 20 after it is detached from superstructure 22.

An enclosing sleeve 64 surrounds the cylinder 48 and has its lower end welded to the plate 55. The sleeve 64 includes a top cover plate 65 welded thereto, and also joined to the vertical plate 43 which has an adjacent opening 66 through which the chamber 40 communicates with the interior of sleeve 64 through a short horizontal conduit formation 67 which includes the plate 65 as its top wall, see FIG. 4.

Each guide post 59 is received slidably through an opening 68 in fixed bottom wall 33, and above this bottom wall is received in an enclosure sleeve or housing 69, having a top wall 70. The bottom end of sleeve 69 is welded to the top of plate 33. Each sleeve 69 has a lock pin anchor ring 71 or block welded therein somewhat above the plate 33 and having a through bore receiving the adjacent guide post 59. Each post 59 has two vertically spaced cross bores 72, one near its top and the second near its longitudinal center. Each such cross bore is adapted to register with a cross axis locking bore 73 in the block 71. A rigid locking pin 74 is insertable through either of the bores 72 when the latter are in registry with the locking bore 73 so that the foot plate 52 can be rigidly locked in the fully retracted or fully extended positions of FIGS. 4 and 3 by the four manual removable locking pins 74.

The entire interior space within the large box-like center section 31 of counterweight assembly 26 is filled up with shot 75 or scrap metal to increase the weight of the counterweight. The enclosure elements 64, 69 and 56 and associated parts prevent the shot or scrap metal from contacting the cylinder 48 or its rod 49 and prevent same from contacting guide posts 59 and from entering the hydraulic hose chamber 40.

The previously-mentioned hoses 41 are connected into cylinder 48 through upper fittings 76. These hoses extend into chamber 40 for coiled storage therein and have quick disconnect couplings 77, FIGS. 1 and 8, on their leading ends. The hoses 41 can be withdrawn through either opening 44 for connection with mating quick disconnect couplings 78, FIG. 8, on extension hoses 79 leading to a control valve 80, of an engine driven pump, FIG. 1, on the crane carrier 20, having an associated control handle 81 by means of which the supply and return of hydraulic fluid to the jack cylinder 48 is regulated. The mating quick disconnect couplings 78 may be right at the control valve 80, in which case the extension hoses 79 are unnecessary, and the hoses 41 are of greater length but are still coiled stored in chamber 40.

The aforementioned side sections 32 of the counterweight assembly 26 are also of rigid box-like construction and are formed by welded top plates 82, bottom plates 83, front and rear walls 84 and 85, and side walls 86. The tops of front and rear walls 84 and 85 are equipped with lifting eyes 87 similar to the eyes or lugs 45.

Figure 6:
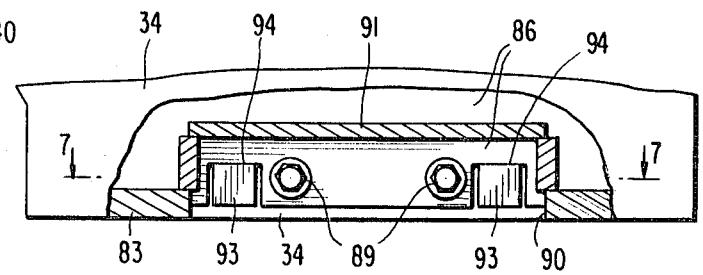
FIG. 6 is a fragmentary vertical section taken on line 6—6 of FIG. 5.
Figure 7:
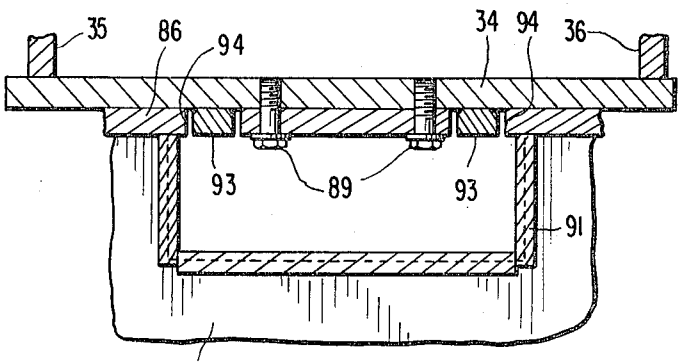
FIG. 7 is a fragmentary horizontal section taken on line 7—7 of FIG. 6.
Figure 5:
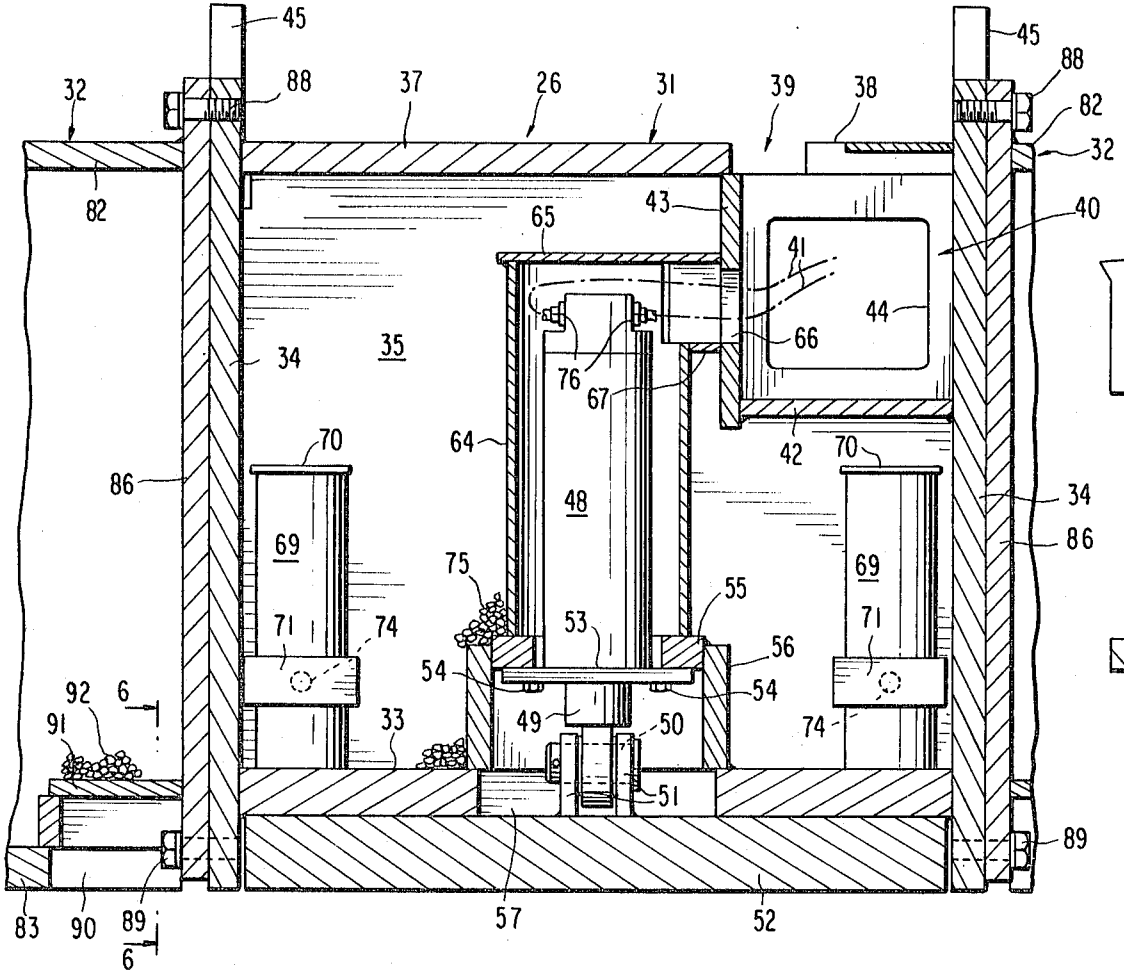
FIG. 5 is a fragmentary transverse vertical section taken on line 5—5 of FIG. 2.

The counterweight side sections 32 are attached rigidly to the side walls 34 of center section 31 by upper bolts 88 and lower bolts 89. The upper bolts 88 are readily accessible at the top of the counterweight. To render the lower bolts 89 readily accessible, openings 90 are formed through bottom plates 83 and a rectangular corner enclosure 91 of welded plate construction is formed above the opening 90 and above and around the pairs of bolts 89. FIGS. 5 through 7. The enclosure 91 also prevents the escape of shot or scrap metal 92 with which the side sections 32 are filled for added weight.

To relieve the bolts 88 and 89 of shear stresses caused by the weights of side sections 32, support lugs 93 welded to side plates 34 of center section 31 engage supportingly in notches 94 of side plates 86 and bear substantially the weights of the two side sections, the bolts serving merely to lock the three sections of the counterweight in assembled relationship, and therefore being stressed primarily in tension.

The method of handling the counterweight assembly 26 in accordance with the present invention is illustrated in FIGS. 1 and 8 through 11*b*. In these figures, the superstructure 22 and boom 24 are rotated a full 180 degrees from their normal transport positions so that the boom 24 and cab 25 extend rearwardly on the crane carrier 20. The boom 24 may be down, as shown in FIG. 1, or may be elevated to a convenient angle prior to beginning the demounting method for the assembly 26.

With the superstructure 22 and counterweight assembly 26 so positioned, the locator sockets 61 of foot plate 52 are directly over and aligned with locator pads 62 on crane carrier plate 63 as illustrated in FIGS. 1 and 8. Quick disconnect coupling parts 77 and 78 are now connected and locking pins 74 are withdrawn and separated from the assembly, FIG. 8.

The control 81 is now operated to extend foot plate 52 downwardly into contact with crane carrier plate 63, FIG. 9, and this places locator pads 62 into locator sockets 61 so that the counterweight assembly cannot be displaced in a horizontal plane during its raising or lowering. Continued extension of cylinder rod 49 to its full limit, FIG. 10, raises the support hooks 46 of the counterweight assembly clear of the pins 47 and associated parts so that the superstructure 22 may rotate on the turntable 21 without striking any part of the released and stably supported counterweight assembly 26. The superstructure 22 and boom 24 are now rotated 180 degrees and the boom is now elevated to a proper angle, if this has not previously been done, so that its lifting cable harness 95, FIG. 11*a*, is positioned for attachment to lifting lugs 45 and 87 of the counterweight assembly.

The post locking pins 74 are now set into place, FIG. 11*a*, the quick disconnect coupling parts 77 and 78 are separated, and the assembly 26 is lifted off of the plate 63 by operation of the crane boom and removed to a desired location, such as the bed of another transport vehicle which may be equipped with locator elements like the elements 62.

In an optional mode, FIG. 11*b*, prior to lifting the assembly 21 off of the crane carrier 20, the rod 49 of cylinder 48 can be retracted to lower the assembly 26 with the foot plate 52 nested against the bottom plate 33. When this procedure is followed, the assembly 26 is rendered more compact for transport or storage, but care must be exercised when re-assembling the counterweight with the superstructure 22 by reverse method steps to again extend the rod 49 and foot plate 52 and thereby elevate the support hooks 46 so that they will clear all parts of the rotating superstructure.

The method of handling the massive counterweight assembly is safe, convenient and efficient. By following the described sequence of steps, it becomes very simple to separate the counterweight assembly from the superstructure 22, lift it aside for separate transport or storage, and to replace it on the superstructure when desired. The advantages of the invention over the prior art should now be apparent to those skilled in the art.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

We claim:

1. A crane counterweight assembly comprising a body portion adapted for supportive attachment to a crane superstructure to counterbalance the superstructure, and raising and lowering means for the counterweight assembly wholly mounted on and carried by the counterweight assembly forming a part of the counterweight mass and enabling its separation from and mounting on a crane superstructure, said raising and lowering means being carried by said counterweight assembly during its separated and mounted positions and adapted to be powered by a power means on a crane.

2. A crane counterweight assembly as defined in claim 1, and said body portion being hollow and said raising and lowering means being disposed within the interior of the body portion.

3. A crane counterweight assembly as defined in claim 2, and the raising and lowering means including a hydraulic jack cylinder adapted to be energized by a crane hydraulic system.

4. A crane counterweight assembly as defined in claim 3, and the raising and lowering means further comprising a vertically extensible and retractable foot element at the bottom of the assembly coupled with said jack cylinder and operated thereby, and positive guide means for the foot element within said body portion.

5. A crane counterweight assembly as defined in claim 4, and releasable locking means for said guide means when the foot element is in fully extended and fully retracted positions.

6. A crane counterweight assembly as defined in claim 5, and lifting elements on the upper portion of said assembly to facilitate bodily lifting the assembly with a crane boom lifting harness.

7. A crane counterweight assembly as defined in claim 2, and enclosure means for said raising and lowering means within the interior of said body portion to shield them from contact with ballast placed in the interior of the hollow body portion.

8. A crane counterweight assembly as defined in claim 7, and means forming a protecting and storage compartment for hydraulic hoses of the raising and lowering means within said body portion and having an access opening in communication with the exterior of the body portion through which hoses may be extended.

9. A crane counterweight assembly as defined in claim 8, and said compartment being in communication with said enclosure means within said body portion.

10. A crane counterweight assembly as defined in claim 1, and said body portion comprising a center section and a pair of opposite side sections coupled with the center section and bodily carried thereby, said raising and lowering means being mounted on said center section of the body portion.

11. In a mobile crane, a crane carrier having a counterweight locator and support means thereon, a turntable mounted superstructure and crane boom on said carrier, a counterweight assembly for the superstructure including means supportively and detachably engageable with the superstructure, and power raising and lowering means for the counterweight assembly wholly mounted on and carried by the counterweight assembly forming a part of the counterweight mass and including a foot element adapted to be extended into supportive engagement with the counterweight locator and support means, said raising and lowering means being carried by said counterweight assembly during its supported and detached positions and adapted to be energized by means on the crane carrier.

12. In a mobile crane as defined in claim 11, said raising and lowering means including a hydraulic cylinder operatively coupled with said foot element and adapted to be powered by the hydraulic system of the crane carrier, and mechanical means to releasably lock the foot element in extended and retracted positions relative to the counterweight assembly.

13. A method of handling a crane counterweight assembly comprising lifting the counterweight assembly by energizing power lifting means contained on the assembly to separate the assembly from supportive means on a crane superstructure, locking the counterweight assembly in a raised self-supporting state free of said superstructure and de-energizing the power lifting means, and then bodily lifting and transporting the locked counterweight assembly including the power lifting means to a required location.

14. A method of handling a crane counterweight assembly comprising lifting the assembly by energizing power lifting means contained within the assembly to separate the assembly from supportive means on a crane, locking the counterweight assembly in a raised self-supporting state free of said supportive means and de-energizing the power lifting means, and rotating the supportive means relative to the locked counterweight assembly to move a lifting and carrying part of the supportive means to an engaging position relative to the counterweight assembly, and lifting and carrying the counterweight assembly by operation of said part.

15. The method of claim 13, and the additional step of extending a supporting foot element of the counterweight assembly during the lifting thereof into supportive engagement with a supporting and locator device.

16. The method of claim 14, and the additional step of extending a supporting foot element of the counterweight assembly during the lifting of the assembly and bringing the foot element into supportive engagement with a supporting and locator member on the crane.

* * * * *